US012765697B2

(12) United States Patent
Ramdeen

(10) Patent No.: US 12,765,697 B2
(45) Date of Patent: Oct. 20, 2026

(54) CONVERTIBLE SLING-TYPE BABY CARRIER

(71) Applicant: Yorkville Products LLC, New York, NY (US)

(72) Inventor: Vishana Ramdeen, New York, NY (US)

(73) Assignee: Yorkville Products LLC, New York, NY (US)

( * ) Notice: Subject to any disclaimer, the term of this patent is extended or adjusted under 35 U.S.C. 154(b) by 284 days.

(21) Appl. No.: 18/528,123

(22) Filed: Dec. 4, 2023

(65) Prior Publication Data

US 2024/0382016 A1 Nov. 21, 2024

Related U.S. Application Data

(60) Provisional application No. 63/503,305, filed on May 19, 2023.

(51) Int. Cl.
*A47D 13/02* (2006.01)
*A45F 4/02* (2006.01)

(52) U.S. Cl.
CPC ..... *A47D 13/02* (2013.01); *A45F 4/02* (2013.01)

(58) Field of Classification Search
CPC ..... A45F 4/02; A47D 13/02
See application file for complete search history.

(56) References Cited

U.S. PATENT DOCUMENTS

| | | | | |
|---|---|---|---|---|
| 5,333,769 | A * | 8/1994 | Skroski | A47D 5/006 5/413 R |
| 9,439,516 | B2 * | 9/2016 | Workman | A47D 13/025 |
| 9,480,344 | B1 * | 11/2016 | Vialpando | B60N 2/2812 |
| 9,730,499 | B2 * | 8/2017 | Ford | A45C 9/00 |
| 10,939,744 | B2 | 3/2021 | Robinson | |
| 10,986,911 | B2 * | 4/2021 | Cotirla | A45F 3/04 |
| 11,272,791 | B2 * | 3/2022 | Warner | A47D 13/025 |
| 11,690,439 | B2 | 7/2023 | Neal | |
| 2002/0023937 | A1 * | 2/2002 | O'Hare | A47C 1/146 224/652 |
| 2007/0170219 | A1 * | 7/2007 | Ballarta | A45F 3/04 224/645 |
| 2007/0175934 | A1 * | 8/2007 | Boal | A47D 13/025 224/159 |
| 2007/0228091 | A1 * | 10/2007 | Shawen | A45F 3/14 224/153 |
| 2008/0087694 | A1 * | 4/2008 | Meng | A47D 13/025 224/160 |

(Continued)

*Primary Examiner* — Brian D Nash
(74) *Attorney, Agent, or Firm* — DILWORTH IP, LLC

(57) ABSTRACT

A convertible baby carrier designed to transition between a bag mode and a carrier mode. This dual-functionality carrier comprises a bag portion with at least one bag connector, a strap featuring a strap connector, and a panel equipped with a panel connector. In the bag mode, the strap connector attaches to the bag connector, aligning the panel with the back surface of the bag portion, enabling the carrier's use as a conventional bag. Transitioning to the carrier mode involves detaching the strap connector from the bag connector and engaging the strap connector with the panel connector. This engagement repositions the panel at an adjustable angle relative to the bag portion's back surface, forming a sling that securely and comfortably cradles a baby.

18 Claims, 8 Drawing Sheets

(56) References Cited

U.S. PATENT DOCUMENTS

| | | | | |
|---|---|---|---|---|
| 2009/0127299 | A1* | 5/2009 | Jamlang | A45F 3/14 224/153 |
| 2010/0006384 | A1* | 1/2010 | Napolitano | A45C 11/00 190/107 |
| 2010/0072236 | A1* | 3/2010 | Parness | A47D 13/02 224/160 |
| 2014/0263491 | A1* | 9/2014 | Telford | A47D 13/025 224/160 |
| 2015/0201761 | A1* | 7/2015 | Wollenberg | A45F 4/02 224/160 |
| 2017/0119173 | A1* | 5/2017 | Telford | A47D 13/025 |
| 2018/0008024 | A1* | 1/2018 | Barton | A45F 3/04 |
| 2018/0035823 | A1* | 2/2018 | Landeros | A45C 13/001 |
| 2018/0235379 | A1* | 8/2018 | Lindeman | A47D 13/025 |
| 2021/0161308 | A1* | 6/2021 | Liao | A47D 13/02 |
| 2023/0225486 | A1* | 7/2023 | Gibbs | A45C 13/30 224/608 |
| 2025/0098872 | A1* | 3/2025 | Hu | A47D 13/025 |

* cited by examiner

CONVERTIBLE SLING-TYPE BABY CARRIER

RELATED APPLICATIONS

The present application claims priority to U.S. Provisional Patent Application No. 63/503,305 filed May 19, 2023, the contents of which are incorporated by reference in their respective entireties for all purposes.

FIELD

The field of the present disclosure relates generally to the field of baby carriers, and more specifically to sling-type baby carriers.

BACKGROUND

The field of baby carriers has seen various developments over the years, with numerous designs aimed at improving the convenience and comfort of carrying infants. Traditional designs have focused on different aspects of usability and support, yet there remains a need for further innovation in this area. Despite the variety of existing solutions, challenges persist in finding an optimal balance between functionality, ease of use, and comfort for both the caretaker and the child.

SUMMARY

Certain aspects of the present disclosure relate to a convertible baby carrier. In certain examples, the convertible baby carrier may comprise a bag portion equipped with at least one bag connector, a strap including a strap connector, and a panel featuring a panel connector. The convertible baby carrier may be configured to transition between a bag mode and a carrier mode. In the bag mode, the strap connector can attach to the at least one bag connector, aligning the panel with the back surface of the bag portion. In the carrier mode, the strap connector may engage with the panel connector, arranging the panel at an angle to the back surface to form a sling, allowing for the carrying of a baby.

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Some embodiments of the disclosure are herein described, by way of example only, with reference to the accompanying drawings. With specific reference now to the drawings in detail, it is stressed that the embodiments shown are by way of example and for purposes of illustrative discussion of embodiments of the disclosure. In this regard, the description taken with the drawings makes apparent to those skilled in the art how embodiments of the disclosure may be practiced.

DETAILED DESCRIPTION

The present disclosure relates to a convertible baby carrier that is structured to transition between a bag mode and a carrier mode, offering convenience and ease of use for caretakers.

Some embodiments of the convertible baby carrier can include a bag portion, indicated as 10, which may include a back surface 11. The bag portion 10 may be equipped with at least one bag connector 12, and may further include one or more bag compartments 13, which can range in number and size. In certain examples, the bag portion 10 provides the primary storage capacity and serves as the structural base in the bag mode, as depicted in FIG. 1.

Figure 1:
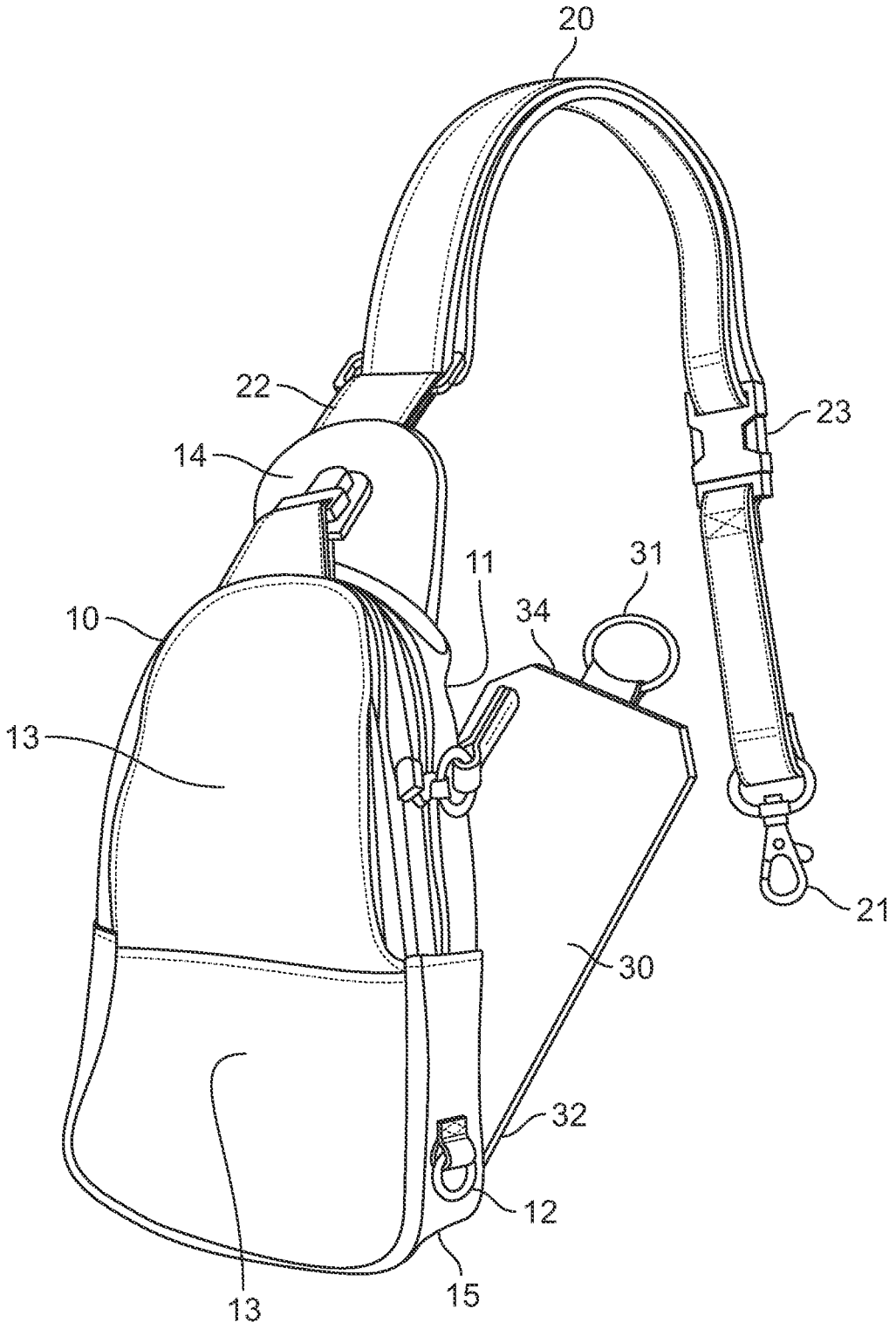
FIG. 1 depicts the components of the convertible baby carrier.

The at least one bag connector 12 may be positioned on a bottom portion of the carrier, designated as 15, as shown in FIG. 1. In certain embodiments, the at least one bag connector 12 may comprise two bag connectors that are laterally spaced on the bottom portion 15. However, the number of bag connectors 12 and their respective locations are not limited to the embodiments described herein and can be placed in any number or location on the carrier without destroying the carrier's intended functions.

In certain examples, a strap, indicated as 20, may be present. The strap 20 can include a strap connector 21, which may be situated on a distal portion of the strap. Some implementations may include a proximal portion 22 of the strap 20 being integral with the top 14 of the bag portion 10. Some implementations may include the proximal portion 22 of the strap 20 being affixed (e.g., sewn or otherwise adhered) to the top 14 of the bag portion 10. The strap 20 can be adjusted for length, accommodating various user preferences and body sizes. In certain examples, the strap 20 may be adjusted using an adjustable fastener such as, but not limited to, a buckle 23. However, the use of the buckle 23 is not mandatory, with other adjustable fasteners, such as, but not limited to, hook-and-loop fasteners, slide adjusters, snap-fit connectors, d-rings, or cord locks, being suitable examples.

Figure 2A:
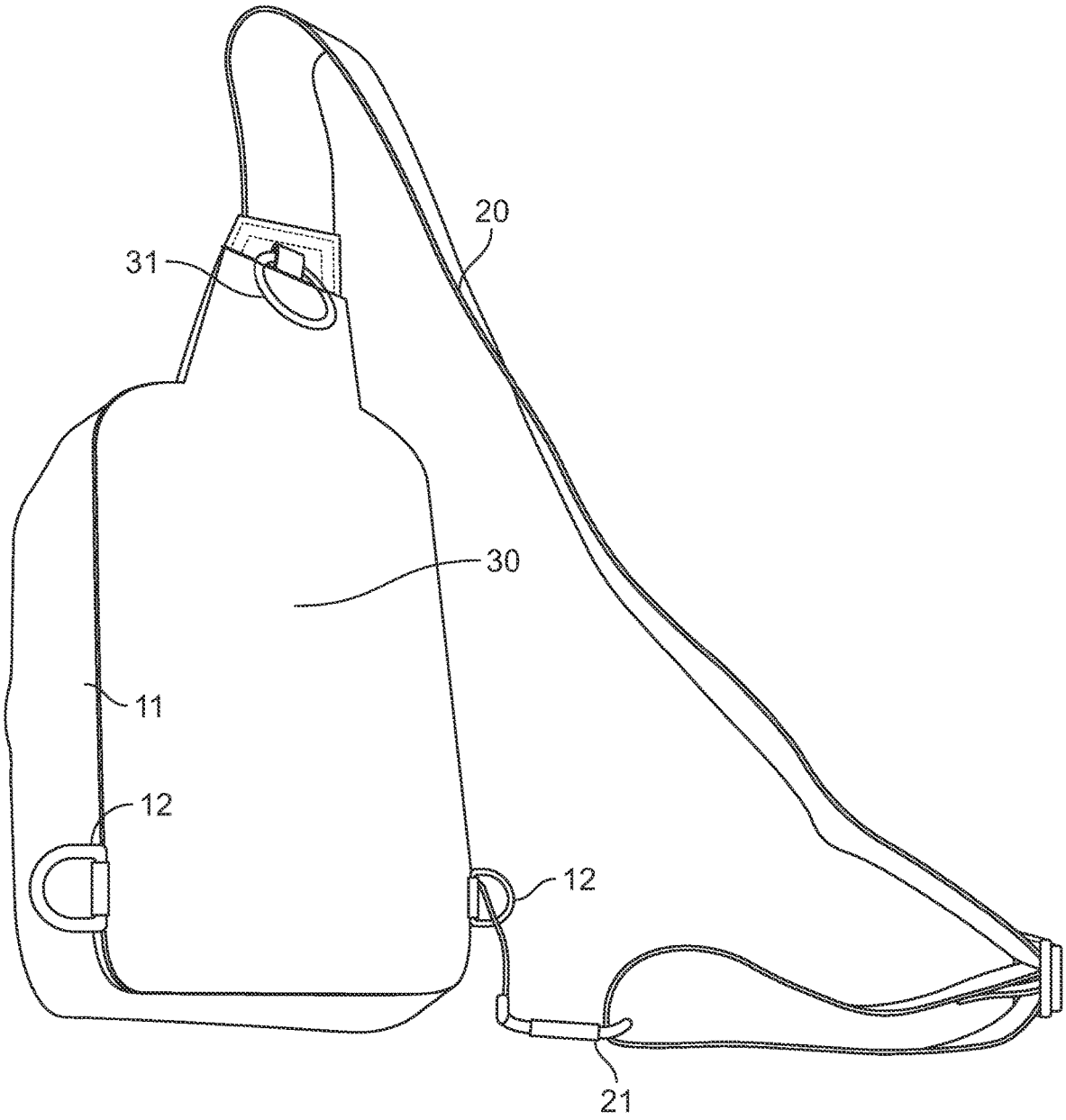
FIGS. 2A, 2B, & 2C depict example configurations of a strap connector, a panel connector, and at least one bag connector when the convertible baby carrier is in the bag mode.
Figure 2B:
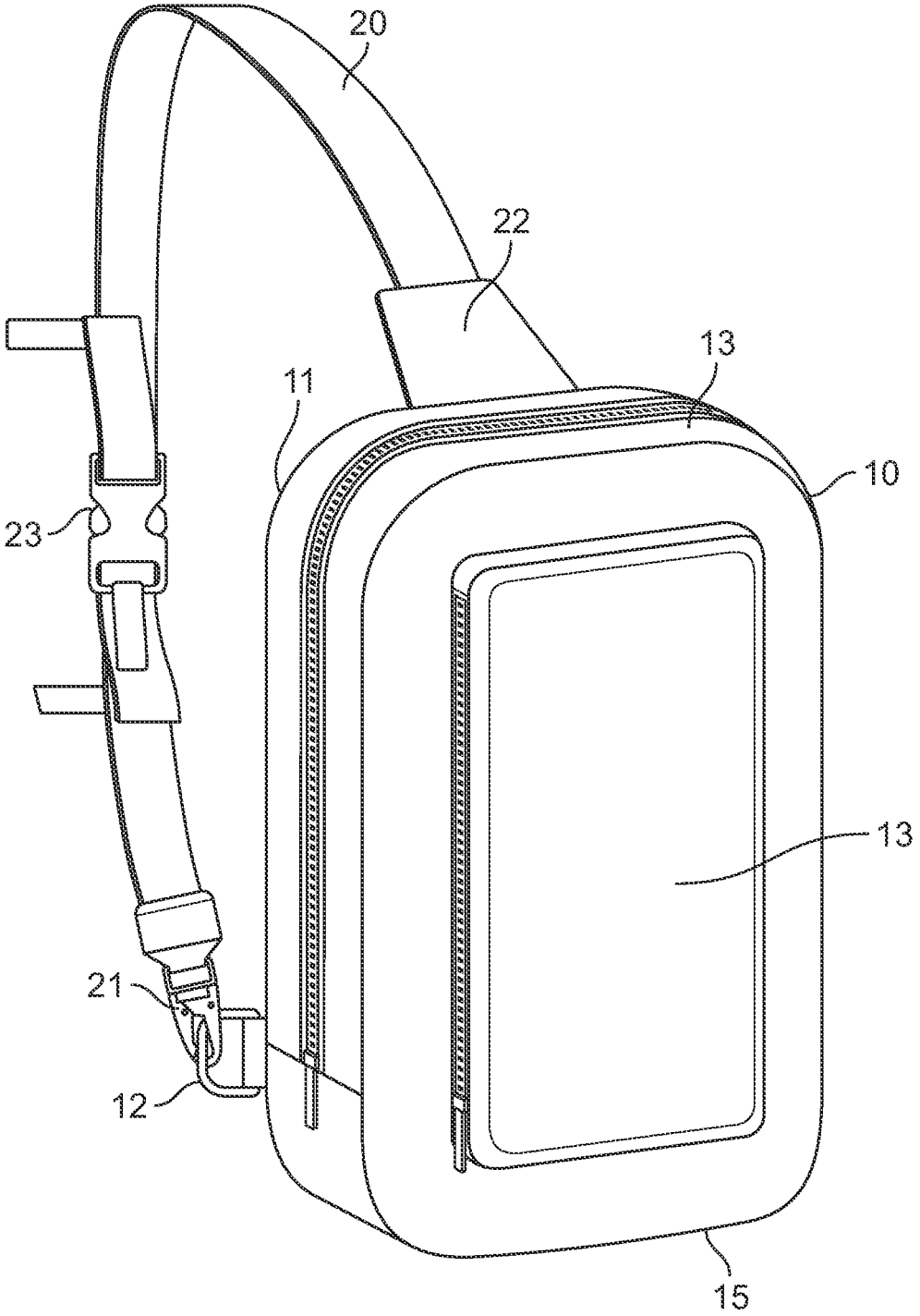

Some embodiments may include a panel, indicated as 30. The panel 30, may, in certain examples, be integral with the bottom of the bag portion 10, via the panel's proximal end 32. The panel 30, may, in certain examples be affixed (e.g., sewn or otherwise adhered) to the bottom of the bag portion 10, via the panel's proximal end 32. Panel 30 may include a panel connector 31, which may be present on the distal portion 34 of the panel 30. Panel 30 can be furled or unfurled relative to the back surface 11 of the bag portion 10. In certain implementations, when in the bag mode, the at least one bag connector 12 engages with the strap connector 21 as shown in FIGS. 2A and 2B, thereby aligning the panel 30 to rest against the back surface 11, as shown in FIG. 2A.

Figure 2C:
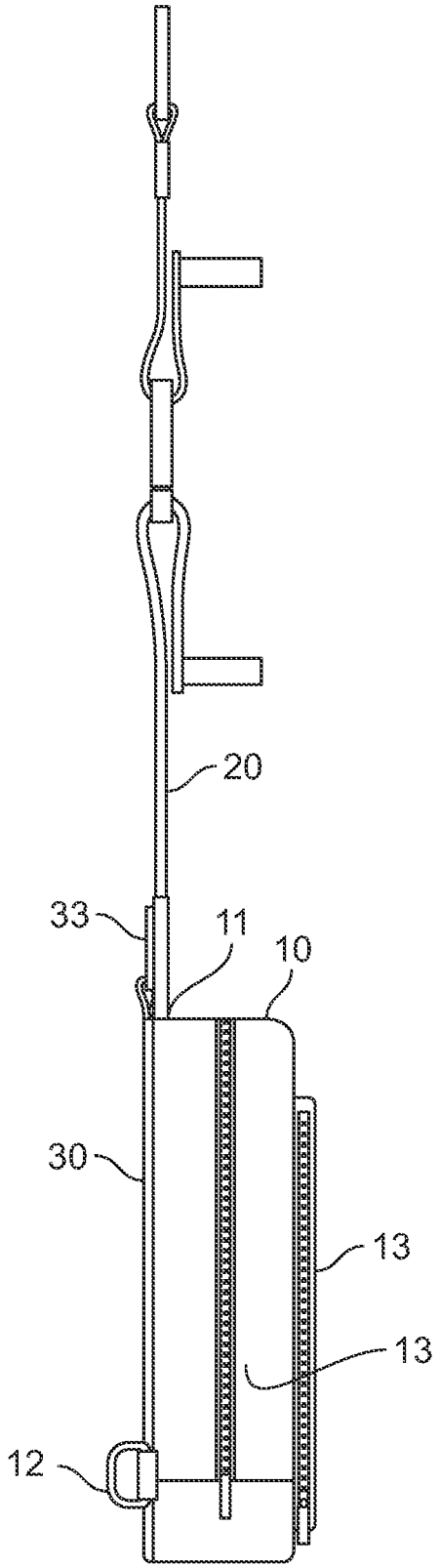

In some examples, the alignment of the panel 30 against the back surface 11 positions the panel 30 in place without requiring the panel 30 to be affixed to the back surface. However, in certain examples, the panel 30 could be affixed to the back surface 11, by a clip 33 as shown in FIG. 2C or by any other suitable fastener or combination thereof known in the art, such as but limited to hook-and-loop fasteners, magnetic fasteners, snaps, adhesive strips, or any other suitable fastener mentioned in the present disclosure. In some examples, regardless of whether clip 33 is present, panel 30 may be flush against the back surface 11 in the bag mode, as shown in FIGS. 2A and 2C.

The connectors 12, 21, and 31 may comprise any suitable connector, such as but not limited to snap connectors, magnetic connectors, hook-and-loop fasteners, buckle connectors, or any suitable combination thereof. Suitable connectors further include, but are not limited to, zippers, ties, latches, press studs, and other mechanical or magnetic fastening systems. The convertible baby carrier's dual-mode functionality is supported by the arrangement and interaction of the bag portion 10, strap 20, and panel 30, along with their respective connectors 12, 21, and 31. These components and their configurations support the operational features of the convertible baby carrier as claimed, providing the necessary structure, adjustability, and conversion capability between the bag mode and the carrier mode.

Figure 3:
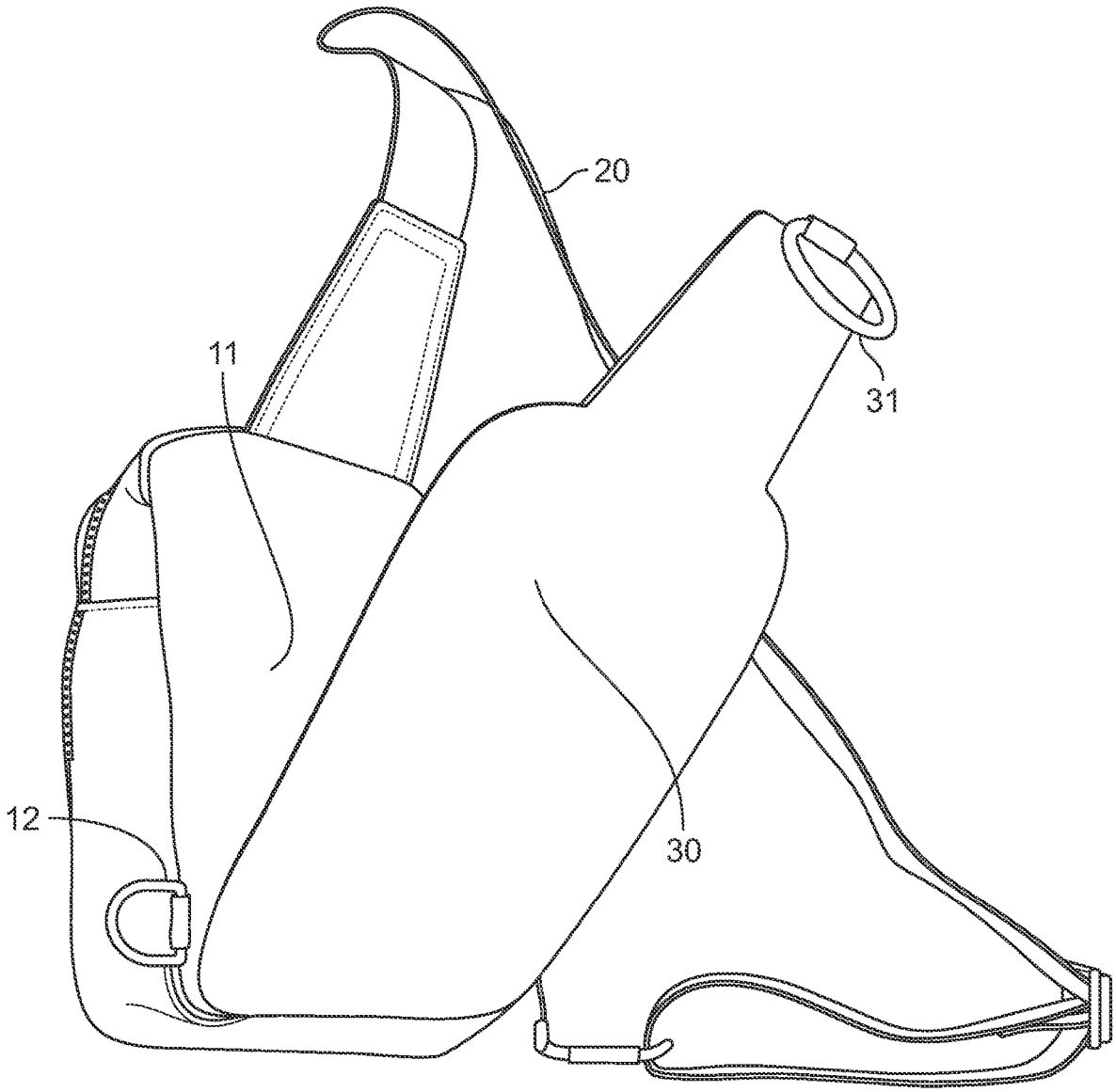
FIG. 3 depicts a panel of the convertible baby carrier being unfurled during a transition between the bag mode and a carrier mode.
Figure 4:
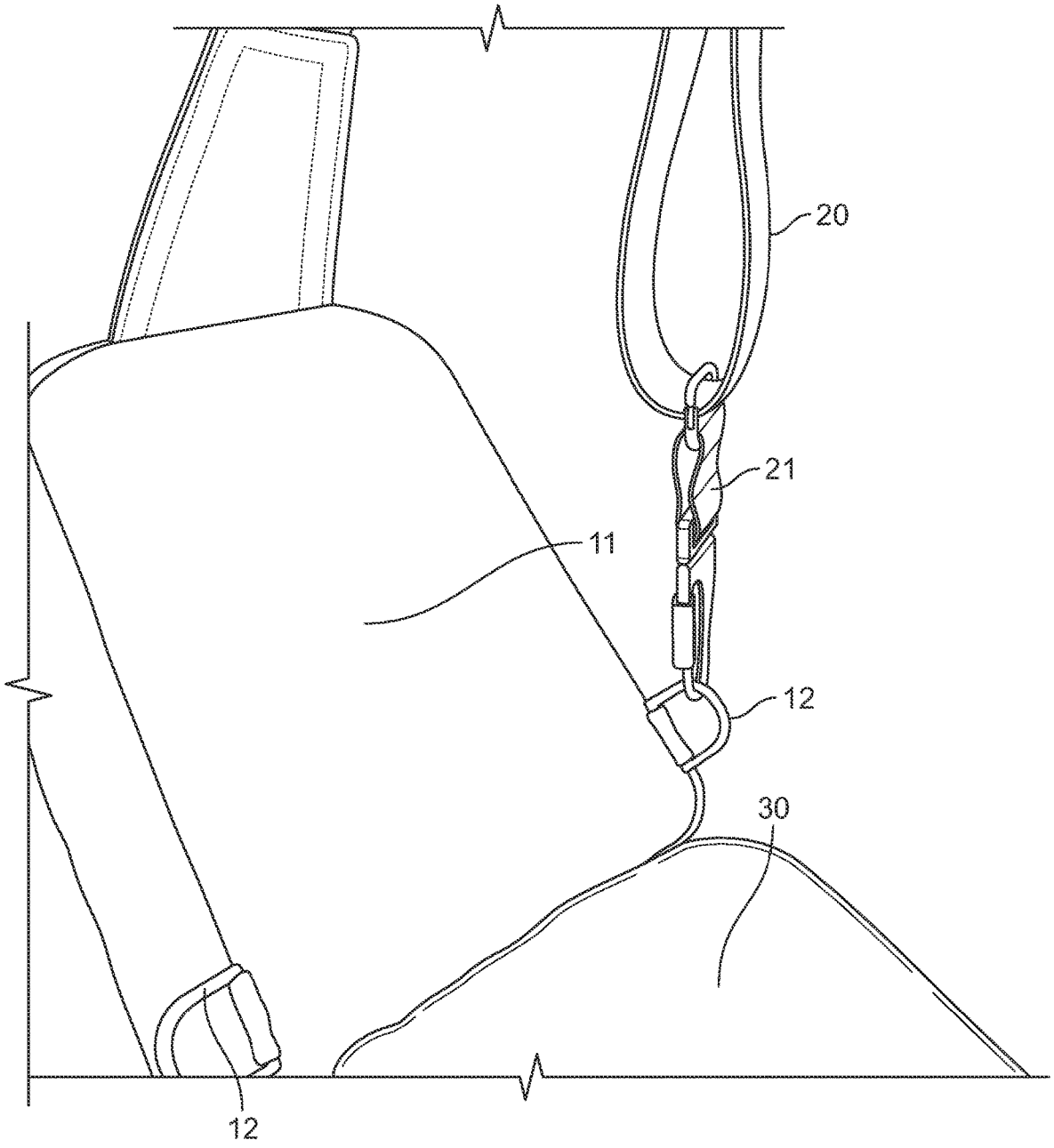
FIG. 4 depicts the unfurled panel in an open position during the transition between the bag mode and the carrier mode.
Figure 5A:
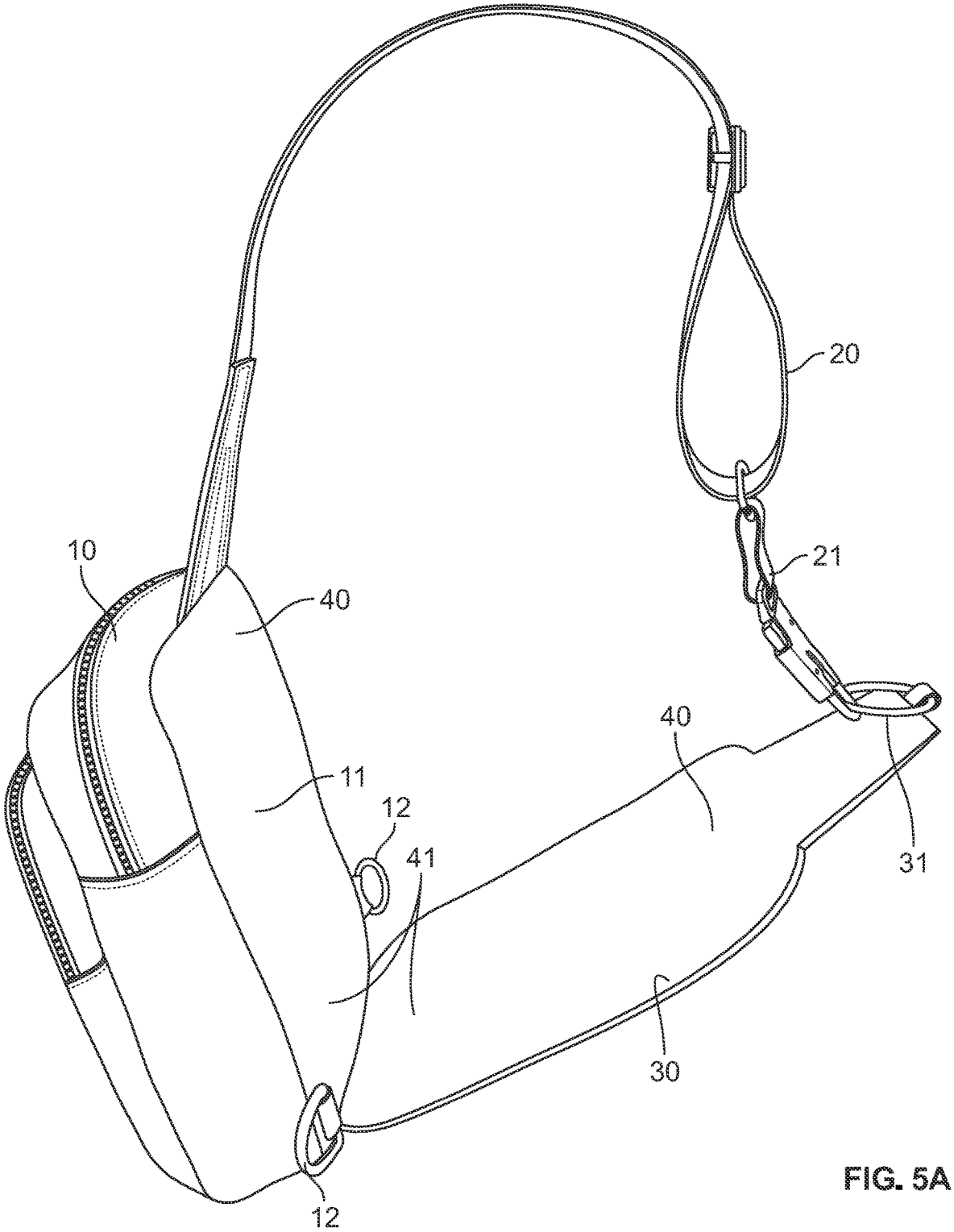
FIGS. 5A & 5B depict example configurations of a strap connector, a panel connector, and at least one bag connector when the convertible baby carrier is in the carrier mode.
Figure 5B:
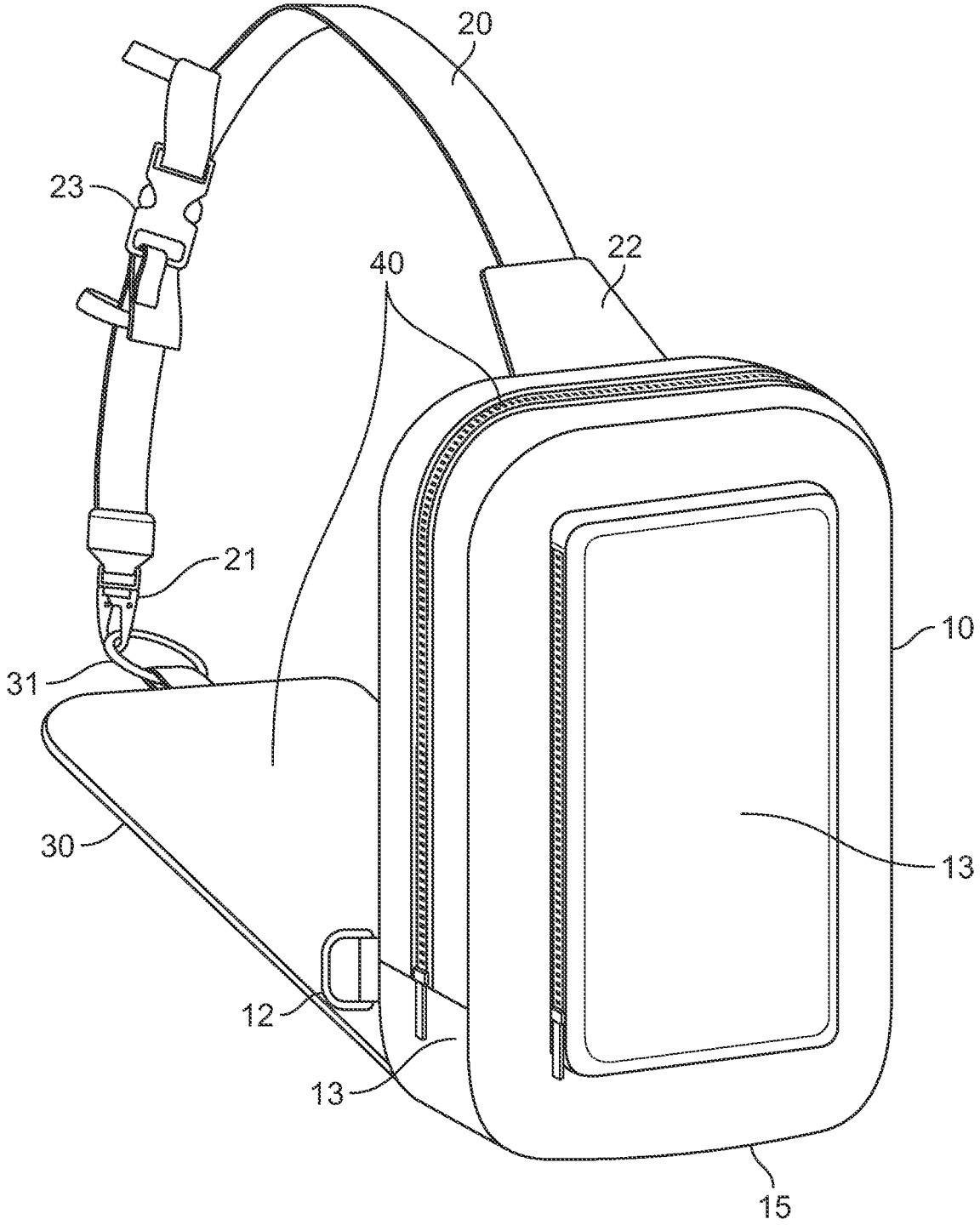

Transitioning to the carrier mode, as illustrated in FIGS. 3-4, can involve releasing the strap connector 21 from the at least one bag connector 12 and engaging the panel connector 31 with the strap connector 21, as shown in FIGS. 5A & 5B. Connecting the panel connector 31 to the strap connector 21 can reposition the panel 30 at an adjustable angle 41 shown in FIG. 5A to the back surface 11, creating a sling 40 configured to cradle a child, as depicted in FIGS. 5A & 5B. In certain examples, the angle 41 of the sling 40 between the panel 30 and the back surface 11 may range from 1° to 180°, including all intermediate angles, thereby supporting an infant while potentially allowing for hands-on support from the user.

In this disclosure and the following claims, the word "or" indicates an inclusive list such that, for example, the list of X, Y, or Z means X or Y or Z or XY or XZ or YZ or XYZ. Also the phrase "based on" is not used to represent a closed set of conditions. For example, a step that is described as "based on condition A" may be based on both condition A and condition B. In other words, the phrase "based on" shall be construed to mean "based at least in part on." Also, the words "a" or "an" indicate "at least one."

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though it may. Furthermore, the phrases "in another embodiment" and "in some other embodiments" as used herein do not necessarily refer to a different embodiment, although it may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

All prior patents, publications, and test methods referenced herein are incorporated by reference in their entireties.

Variations, modifications and alterations to embodiments of the present disclosure described above will make themselves apparent to those skilled in the art. All such variations, modifications, alterations and the like are intended to fall within the spirit and scope of the present disclosure, limited solely by the appended claims.

Any feature or element that is positively identified in this description may also be specifically excluded as a feature or element of an embodiment of the present disclosure as defined in the claims.

The disclosure described herein may be practiced in the absence of any element or elements, limitation or limitations, which is not specifically disclosed herein. Thus, for example, in each instance herein, any of the terms "comprising," "consisting essentially of and "consisting of" may be replaced with either of the other two terms. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A convertible baby carrier comprising:

a bag portion comprising at least one bag connector;

a strap comprising a strap connector, wherein the strap is integral with a top of the bag portion; and a panel comprising a panel connector;

wherein the convertible baby carrier has a bag mode and a carrier mode, wherein in bag mode, the strap connector connects to the at least one bag connector, aligning the panel with a back surface of the bag portion; and wherein in carrier mode, the strap connector connects to the panel connector, orienting the panel at an angle with the back surface to form a sling.

2. The convertible baby carrier of claim 1, the bag portion further comprising at least one bag compartment.

3. The convertible baby carrier of claim 2, wherein the bag portion comprises multiple bag compartments.

4. The convertible baby carrier of claim 1, wherein the strap connector is located on a distal portion of the strap.

5. The convertible baby carrier of claim 1, wherein a proximal portion of the strap is integral with the bag portion.

6. The convertible baby carrier of claim 1, wherein the panel connector is located on a distal portion of the panel.

7. The convertible baby carrier of claim 1, wherein the strap is adjustable.

8. The convertible baby carrier of claim 7, wherein the strap comprises a buckle configured to adjust a length of the strap.

9. The convertible baby carrier of claim 1, wherein at least one of: the at least one bag connector, the strap connector, the panel connector, or any combination thereof comprise hook and loop connectors, snap connectors, magnetic fasteners, strings, clasps, clips, or any combination thereof.

10. The convertible baby carrier of claim 1, wherein the at least one bag connector is adjacent to a proximal portion of the panel.

11. The convertible baby carrier of claim 1, wherein the sling is configured to cradle a child.

12. The convertible baby carrier of claim 1, wherein the sling is designed to provide weight support but is not entirely hands-free.

13. The convertible baby carrier of claim 1, wherein the panel is fastened to the back surface in bag mode.

14. The convertible baby carrier of claim 1, wherein the angle between the panel and the back surface is between 1° and 180° in carrier mode.

15. A convertible baby carrier comprising:

a bag portion comprising at least one bag connector;

a strap comprising a strap connector; and a panel comprising a panel connector, wherein the a proximal portion of the panel is integral with a bottom of the bag portion;

wherein the convertible baby carrier has a bag mode and a carrier mode, wherein in bag mode, the strap connector connects to the at least one bag connector, aligning the panel with a back surface of the bag portion; and wherein in carrier mode, the strap connector connects to the panel connector, orienting the panel at an angle with the back surface to form a sling.

16. A convertible baby carrier comprising:

a bag portion comprising at least one bag connector, wherein the at least one bag connector is located on a bottom portion of the convertible baby carrier;

a strap comprising a strap connector; and a panel comprising a panel connector;

wherein the convertible baby carrier has a bag mode and a carrier mode;

wherein in bag mode, the strap connector connects to the at least one bag connector, aligning the panel with a back surface of the bag portion; and wherein in carrier mode, the strap connector connects to the panel connector, orienting the panel at an angle with the back surface to form a sling.

17. The convertible baby carrier of claim 16, wherein the at least one bag connector comprises two bag connectors that are laterally spaced on a bottom portion of the convertible baby carrier.

18. A convertible baby carrier comprising:

a bag portion comprising at least one bag connector;

a strap comprising a strap connector; and a panel comprising a panel connector;

wherein the convertible baby carrier has a bag mode and a carrier mode, wherein in bag mode, the strap connector connects to the at least one bag connector, aligning the panel with a back surface of the bag portion;

wherein in carrier mode, the strap connector connects to the panel connector, orienting the panel at an angle with the back surface to form a sling; and wherein the panel is configured to be furled and unfurled to transition between bag mode and carrier mode respectively.

* * * * *